US006674234B2

(12) United States Patent
Kim et al.

(10) Patent No.: US 6,674,234 B2
(45) Date of Patent: Jan. 6, 2004

(54) THIN FILM ELECTROLUMINESCENT DEVICE HAVING THIN-FILM CURRENT CONTROL LAYER

(75) Inventors: Yong-Shin Kim, Taejon (KR); Sun Jin Yun, Taejon (KR); Sang-Hee Park, Taejon (KR); Yong Eui Lee, Taejon (KR)

(73) Assignee: Electronics and Telecommunications Research Institute, Taejon (KR)

( * ) Notice: Subject to any disclaimer, the term of this patent is extended or adjusted under 35 U.S.C. 154(b) by 104 days.

(21) Appl. No.: 09/978,456

(22) Filed: Oct. 16, 2001

(65) Prior Publication Data

US 2002/0101153 A1 Aug. 1, 2002

(30) Foreign Application Priority Data

Dec. 1, 2000 (KR) ..... 2000-72323

(51) Int. Cl.[7] ..... H05B 33/02
(52) U.S. Cl. ..... 313/506; 313/503; 313/509
(58) Field of Search ..... 313/503, 506, 313/509

(56) References Cited

U.S. PATENT DOCUMENTS 4,416,933 A * 11/1983 Antson et al. ..... 313/506
4,859,904 A 8/1989 Higton et al.
5,229,628 A 7/1993 Kobayashi
5,796,120 A 8/1998 Summers et al.
6,525,467 B1 * 2/2003 Eida et al. ..... 313/506

* cited by examiner

*Primary Examiner*—Tho D. Ta
(74) *Attorney, Agent, or Firm*—Blakely, Sokoloff, Taylor & Zafman

(57) ABSTRACT

The inventive thin-film DC-driving electroluminescent device (ELD) is characterized by the thin-film current control layer which is inserted between a thin film phosphor layer and metal electrodes. This kind of ELD has the advantages of having a lower operation voltage than that of the conventional thin-film AC ELD and a higher resolution than that of the conventional thin-film/powder hybrid DC ELD. The thin-film current control layer acts as an energy barrier layer which supplies energetic electrons into said phosphor layer by a field-assistant injection of electron, and a current-limiting layer which prevents an electric field breakdown of said electroluminescent device caused by an excess current flow. The current control layer is embodied with a multilayered thin film laminated by an alternate deposition of metal oxides. In another embodiment, the current control layer consists of both an energy barrier layer and a current-limiting layer, separately formed.

8 Claims, 5 Drawing Sheets

(PRIOR ART)

THIN FILM ELECTROLUMINESCENT DEVICE HAVING THIN-FILM CURRENT CONTROL LAYER

FIELD OF THE INVENTION

The present invention relates to an electroluminescent device (ELD); and, more particularly, to a thin-film ELD having a thin-film current control layer.

PRIOR ART OF THE INVENTION

In general, an ELD is designated to the device using a phenomenon of light emission when an electric field is applied upon material. Such ELD is largely classified into an organic ELD and an inorganic ELD according that the material provided as a phosphor layer is organic or inorganic material. The inorganic ELD is also classified into a thin film and a thick film type according to a thickness of phosphor layer.

Particularly, the thin-film ELD includes an alternate current (AC) and a direct current (DC) driving type whether an applied electric field has a polarity or not.

The AC thin-film ELD having two dielectric layers on upper and lower parts of a phosphor layer, has a long lifetime and a stabilized operation in comparison with the DC type, thus AC thin-film ELD has been applied to a display device which requires an endurance and a high resolution. However, the AC thin-film ELD requires high operating voltage of about 150~250 $V_P$, therefore, an expensive driving circuit is needed to operate the AC thin-film ELD.

Meantime, since the DC thin film ELD has a merit of a low operation voltage, much attention has paid to develop a device with a high luminous efficiency and a good reliability by appropriately controlling electron supply into the phosphor layer.

An initial DC type ELD was a stacking structure of transparent electrodes, a thick-film phosphor layer, and metal electrodes in order. This device was required a forming process in order to make an operation of such thick ELD stable. During the forming process, much current flows across a device, and the phosphor layer is aged to a stabilized state. In a case of ZnS:Mn,Cu conductive thick-film phosphor, non-conductive ZnS:Mn layer with a thickness of about 1 $\mu$m between a transparent electrode and the ZnS:Mn, Cu layer is formed through the forming process. In order to eliminate the forming process which causes an inconvenience and a difficulty in its control, the U.S. Pat. No. 4,859,904 disclosed a DC type ELD based on a thin-film/powder hybrid structure. The structure of this device consists of a transparent substrate, transparent electrodes, a thin-film phosphor layer, a thick-film current limiting layer, and metal electrodes in order. The thick-film current limiting layer was provided through a use of $MnO_2$ powder. In this device, a thin-film phosphor and $MnO_2$ powder layers work the same function of the nonconductive ZnS:Mn layer and conductive thick ZnS:Mn,Cu layer above, respectively.

In such ELD with the thin-film/powder hybrid structure, a contrast ratio of the device can be improved and a reduction of luminescence can be prevented by inserting a black color layer between the thin-film phosphor layer and the thick film current limiting layer.

With reference to FIG. 1, the U.S. Pat. No. 5,229,628 proposed an advanced DC-type hybrid ELD with a better reliability and a higher luminous efficiency than those of the thin-film/powder hybrid structure above. FIG. 1 illustrates an new DC-type thin-film/powder hybrid ELD with power supply 18 which has a stacking structure of a transparent substrate 11, transparent electrodes 12, a thin-film phosphor layer 13, a thin-film insertion layer 14, a thick-film current-limiting layer 15, and metal electrodes 17. As one of its embodiments, they used the thin-film phosphor layer 13 of 1 $\mu$m ZnS:Mn, the thin-film insertion layer 14 of 0.1 $\mu$m ZnSe, and the thick-film current limiting layer 15 of 15 $\mu$m $MnO_2$. This device demonstrated an efficient of 0.80 lm/W and a lifetime of 20,000 hours or over. The insertion layer 14 acts as an energy barrier between the thin-film phosphor layer 13 and the thick-film current limiting layer 15, therefore the insertion layer 14 provides energetic electrons into the phosphor layer 13 by a field-assistant injection. The DC type thin-film/powder hybrid ELD with the insertion layer 14 provides a brightness and an efficiency increase of 1.5 times or over in comparison with a case of non-insertion. However, the DC thin-film/powder hybrid ELD shown in FIG. 1 has some shortcomings such that it is difficult to embody a flat display panel with a high resolution due to its thick-film characteristics and a luminous efficiency is lower than that of the conventional AC thin-film ELD.

Though not shown in the drawings, the U.S. Pat. No. 5,796,120 as another conventional technique proposed a tunnel type thin-film ELD. The tunnel type thin-film ELD was constructed by a stacking structure of a substrate, bottom electrodes, a lower thin-film energy barrier layer, a thin-film phosphor layer, an upper thin-film energy barrier layer and upper electrodes. In this tunnel thin-film ELD, when the electric field is applied the device, the electrons supplied from the metal electrode enter into the phosphor layer by tunneling the barrier layer such as $CaF_2$ thin-film with a thickness of 5 nm and below. This device demonstrated to be operated at low voltage and to be able to control the luminescent characteristics with the applied filed and the barrier layer.

Practically, it is very difficult to deposit the very thin energy barrier layer less than 5 nm with a good thickness uniformity and a lattice-matched epitaxial growth. This kind of growth is only possible by a molecular beam epitaxy (MBE) method in a case that lattice constants between the energy barrier layer and the phosphor layer (or bottom electrode) coincide well. In addition, the thickness uniformity is very important factors to ensure a reliability of the device and to control a quantity and an energy of electrons tunneled into the phosphor layer.

SUMMARY OF THE INVENTION

Therefore, it is an object of the present invention to provide a thin-film ELD capable of driving at a low voltage and increasing a luminous efficiency and a resolution.

To achieve these and other advantages, and in accordance with the purpose of the present invention, in the thin-film ELD based on a stacking structure of a transparent substrate, transparent electrodes, a thin-film phosphor layer, a current control layer and metal electrodes in order, the ELD is constructed by a characteristic that the thin-film current control layer acts as an energy barrier layer, which supplies energetic electrons into the phosphor layer by a field-assistant injection of electron, and a current-limiting layer which prevents an electric field breakdown of the device caused by an excess current flow.

Further, in the inventive thin-film ELD comprising of a stacking of a transparent substrate, transparent electrodes, a thin-film phosphor layer, an energy barrier layer, a current-limiting layer and metal electrodes in order, it is characterized with that the energy barrier layer supplies energetic electrons into the phosphor layer by a field-assistant injection of electron, and the current-limiting layer prevents an electric field breakdown of the device caused by an excess current flow.

BRIEF DESCRIPTION OF THE DRAWINGS

The above and other objects and features of the instant invention will become apparent from the following description of preferred embodiments taken in conjunction with the accompanying drawings, in which.

PREFERRED EMBODIMENT OF THE INVENTION

Hereinafter, preferred embodiments of the present invention will be described in detail with reference to the accompanying drawings.

Figure 1:
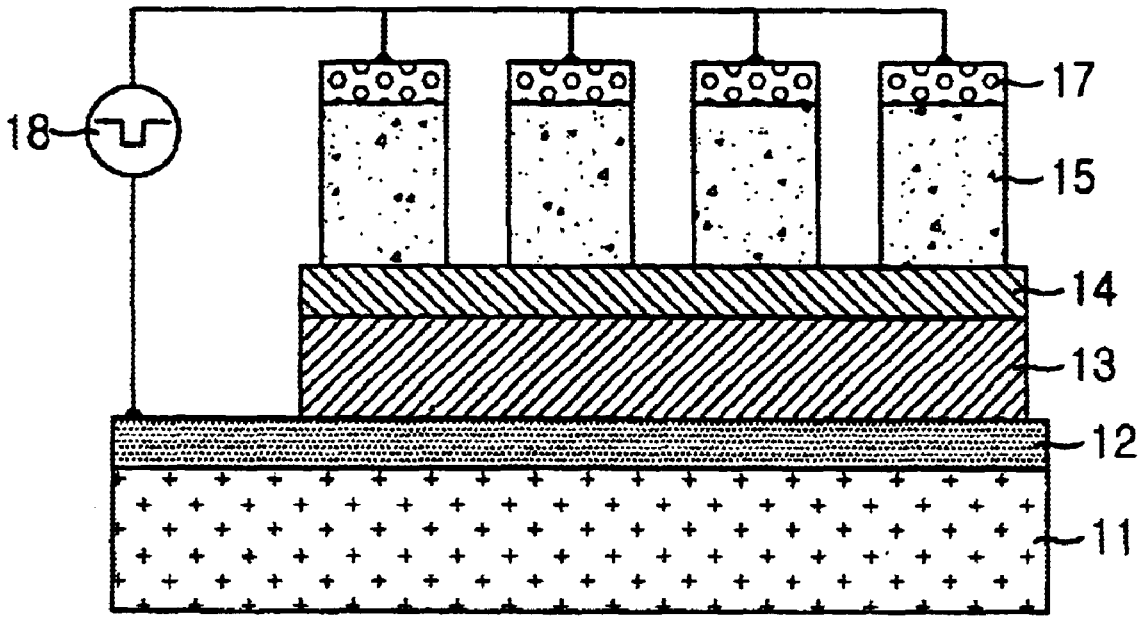
FIG. 1 is a structural sectional view of a DC type ELD having a thick-film current limiting layer in a conventional device.
Figure 2:
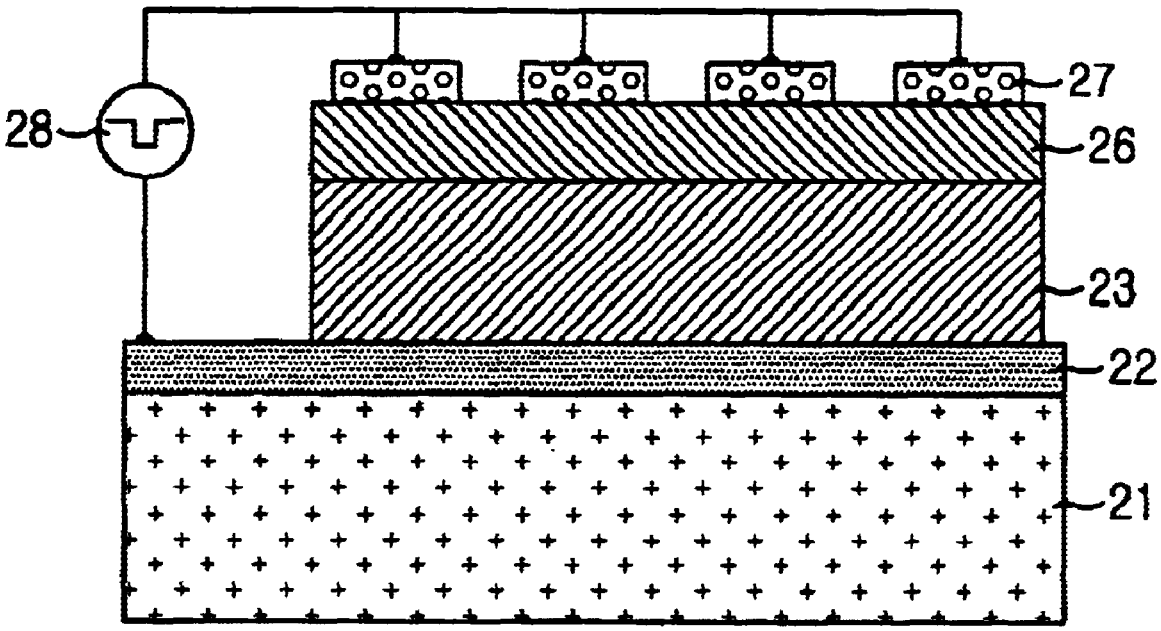
FIG. 2 represents a structural sectional view of a DC thin-film ELD in a first embodiment of the present invention.

FIG. 2 is a structural sectional view of a DC driving type thin film ELD having a current control layer in a first embodiment of the present invention. In FIG. 2, it is provided a structure laminated in order by transparent electrodes 22, a thin-film phosphor layer 23, a thin-film current control layer 26 and metal electrodes 27 on a transparent substrate 21, and it is also constructed in such a way that a positive voltage pulse against the metal electrodes 27 is applied to the transparent electrodes 22 by using a pulse type DC power supplying equipment 28.

In the transparent substrate 21, any one out of a glass substrate and a plastic substrate is used, the glass substrate being for enduring a following process of high temperature and being free from an alkali metal pollution and the plastic substrate having a prominent transmission factor in a visible ray area.

As the transparent electrodes 22 formed on the transparent substrate 21, any one out of ITO (Indium-Tin-Oxide), $CdSnO_3$ and ZnO having an adding of IIIb Group metal can be used. Generally, the ITO materials specially having a prominent conduction and transmission factor are mainly used. Herewith, the transparent electrodes 22 are manufactured according to a required shape by using a photolithography and an etching processes before depositing the thin-film phosphor layer 23.

In the thin-film phosphor layer 23 formed on the transparent electrodes 22, IIb–VIb, IIa–VIb and alkaline-earth thiogallate compounds are used as host material, and rare-earth or transition metals serve as a luminescent center. Sometimes, the luminescent active metals have a complex form with adding of auxiliary elements for a charge balance and a luminescence enhancement. The host materials of the phosphor layer 23 are used any one out of ZnS, ZnSe, CaS, SrS, SrSe, $CaGa_2S_4$ and $SrGa_2S_4$, and the luminescent center metals are selected any one out of Mn, Ce, Tb, Pb, Eu, Tm, Sm, Pr, Gd, Ho, Nd, Dy, Yb, Lu, Er and Cu. As the auxiliary adding element, any one out of F, Cl and Ag is commonly used with the concentration of about 0.1~2.0 at. %. The representative phosphor materials fabricated by using the host material, the luminescent center metal, and the auxiliary adding element are ZnS:Mn, $Zn_xMg_{1-x}S$:Mn, ZnS:Tb,F, ZnS:Sm,Cl, ZnS:Tm,F, CaS:Eu; CaS:Ce, CaS:Pb, SrS:Ce, SrS:Cu,Ag, $CaGa_2S_4$:Ce, and $BaAl_2S_4$:Eu. In addition, the phosphor layer 23 can be manufactured by combining the materials in the forms of multilayered and composite types.

Further, a thin layer of oxide or sulfide films can be inserted between the phosphor layer 23 and the transparent electrodes 22 to increase an interfacial adhesion strength and to prevent the phosphor layer 23 from being degraded by the intrusion of elements existing in the transparent electrode. The maximum thickness of the insertion layer is less than 10 nm.

The thin-film current control layer 26 formed on the phosphor layer 23 acts as an energy barrier layer and current limiting layer. Therefore, the current control layer 26 prevents an electric field breakdown of the device from the excessive current flow through the device by limiting a maximum density of current and supplies energetic electrons into said phosphor layer by a field-assistant injection of electron.

A value of the maximum current density generally required in the ELD is 1~500 mA/cm$^2$. In order to embody the current limiting characteristics of the invention, possible materials are single oxide thin-films such as $Ta_2O_5$, $Al_2O_3$, $TiO_2$, $HfO_2$, $Y_2O_3$, $SiO_2$, SiON, $PbTiO_3$, $BaTiO_3$, $BaTa_2O_6$, $PbNbO_6$, $SrTiO_3$, $PbTiO_3$, $Nb_2O_3$, $ZrO_2$, PbO and Pb(Zr,Ti)$O_3$, and single sulfide films. Other possible materials are the composite films and the multilayered thin-films made by the thin-films above. Among these, the promising materials are the multilayered oxide thin-films such as $(Al_2O_3/TiO_2)_n$, $(SiON/TiO_2)_n$, $(SiO_2/TiO_2)_n$, and $(Ta_2O_5/TiO_2)_n$.

Figure 3:
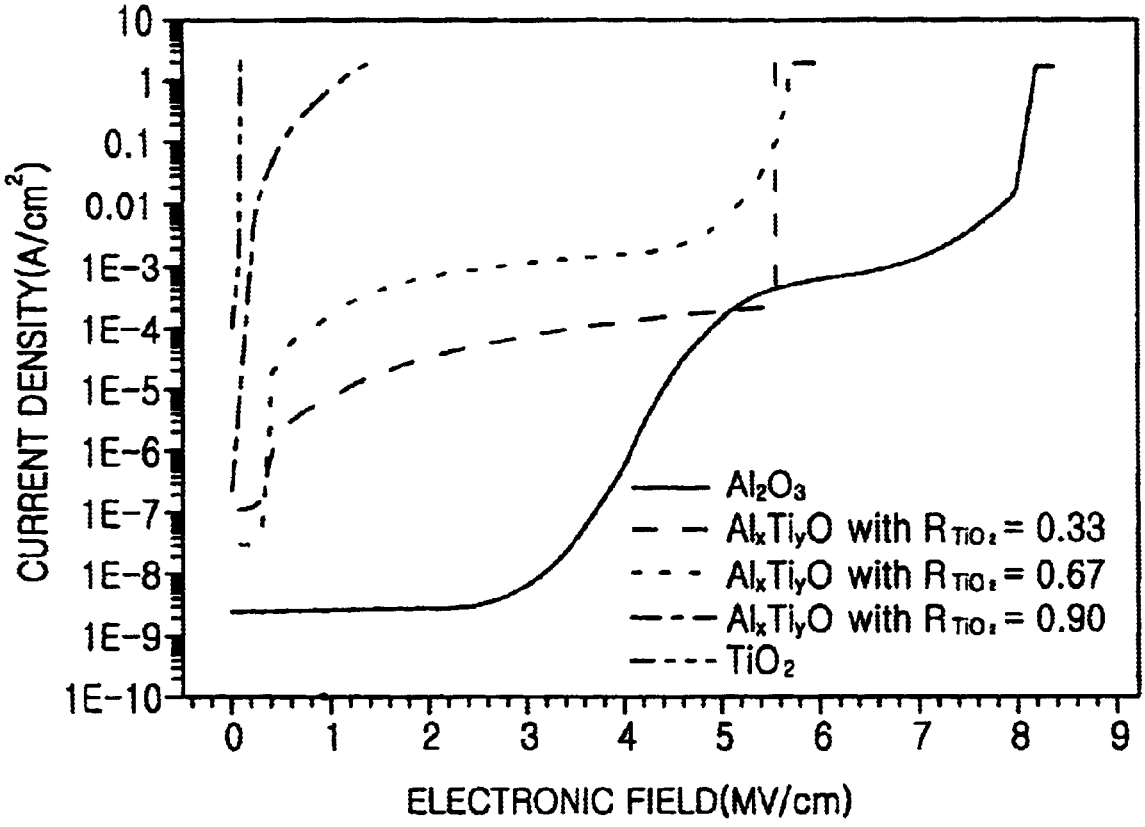
FIG. 3 provides a characteristic graph showing current density versus electric field strength of the thin-film current limiting layer with a multilayered structure of $(Al_2O_3/TiO_2)_n$.

FIG. 3 is a graph showing the current density versus electric field strength of the multilayered thin-film of $(Al_2O_3/TiO_2)_n$ grown by an atomic layer deposition (ALD) method as the thin-film current-limiting layer. $R_{TiO2}$ represents a relative thickness ratio of $TiO_2$ layers to an overall thickness of $(Al_2O_3/TiO_2)_n$ thin-film. Herewith, the overall thickness of the multilayered thin-film grown by an alternative deposition of $Al_2O_3$ and $TiO_2$ is 50–500 nm, and the relative thickness rate of $TiO_2$ layers is as the following equation 1.

$$R_{TiO_2} = \frac{d(TiO_2)}{d(Al_2O_3) + d(TiO_2)} \qquad \text{[Equation 1]}$$

As shown in FIG. 3, the relative thickness ratio, $R_{TiO2}$, is changed within a range of 0~1, and controls the value of a maximum current density. In cases of $R_{TiO2}$=0.33 and 0.67, the current density variations show having a nearly constant value of a current density within the electric field strength of 0.5–4.5 MV/cm. It demonstrates that multilayered $(Al_2O_3/TiO_2)_n$ material can control the value of maximum current density in a range of a wider electrical field strength by changing the relative thickness ratio of $TiO_2$.

As another example not shown in the drawing, the current density-electric field strength characteristics of $(Al_2O_3/$ $SiO_2)_n$ multilayered thin-film have a similar behavior with that of $(Al_2O_3/TiO_2)_n$ above.

Meantime, the thin-film current control layer 26 can be constructed by thin-films that satisfy characteristics of the current-limiting and the energy barrier.

The thin-film energy barrier layer has to serve as an energy barrier for injecting effective electrons with high kinetic energy into phosphor layer 23. A conducting energy level of the current control layer is higher than those of the metal electrode and the phosphor layer. When a voltage pulse is applied to the metal electrode 27 formed on the current control layer 26 with a negative polarity, the current control layer acts as the energy barrier layer for the electron conduction from the metal electrode to the phosphor layer. If appropriate materials are chosen for the current control layer, the electron conduction is possible by a field-assistant injection into the phosphor layer. When an electric field is applied, the electron injection through the energy barrier layer can occur by the low-lying conduction state president due to defect states of the current control layer. Since the field-assistant electrons originate from tunneling from the metal electrode into the phosphor through the low-lying conduction states of the current control layer, their kinetic energy is high in comparison with the electrons in case without barrier layer, which leads to an efficient luminescence.

The most promising thin-film energy barrier materials are gained by using any one II–VI Group compound out of ZnS, ZnO, ZnSe, CaS, CaSe, CaTe, SrS, SrSe, SrTe, CdS, BaO, BaS, BaSe and BaTe having bandgap energy of 2 eV or more. Other possible materials are metal oxides such as $Al_2O_3$, $Ta_2O_5$, $SiO_2$, SiON, $TiO_2$ and $SnO_2$. In addition, the multilayered structure materials of oxides and/or sulfide films can be also used as the energy barrier layer. In multilayered structure, a lamination of very thin-films can induce an efficient injection of electron by a consecutive tunneling mechanism.

The thin-film current control layer 26, and the phosphor layer 23 are formed by using any one method among evaporation, sputtering, multi-source deposition (MSD), metal-organic chemical vapor deposition (MOCVD), halogen-transport CVD, and atomic layer deposition (ALD) methods. The ALD is one of the most ideal deposition methods for manufacturing the multilayered thin film with a high quality of physical properties because of its inherent growth mechanism by the sequential reactive surface reactions between gaseous chemicals and the reactants adsorbed on a substrate surface.

The metal electrodes 27 formed on the thin film current control layer 26 are mainly fabricated by using aluminum (Al) materials. Other materials are possible if they have the following requirements for the electrodes: a low resistivity, a good adhesiveness to the current control layer, no metal-ion migration at high electric field, and an ability to prevent breakdown spread. In order to display a character or a picture of a desired shape, the metal electrodes 27 also require a patterning process like the patterned transparent electrodes 22.

Figure 4:
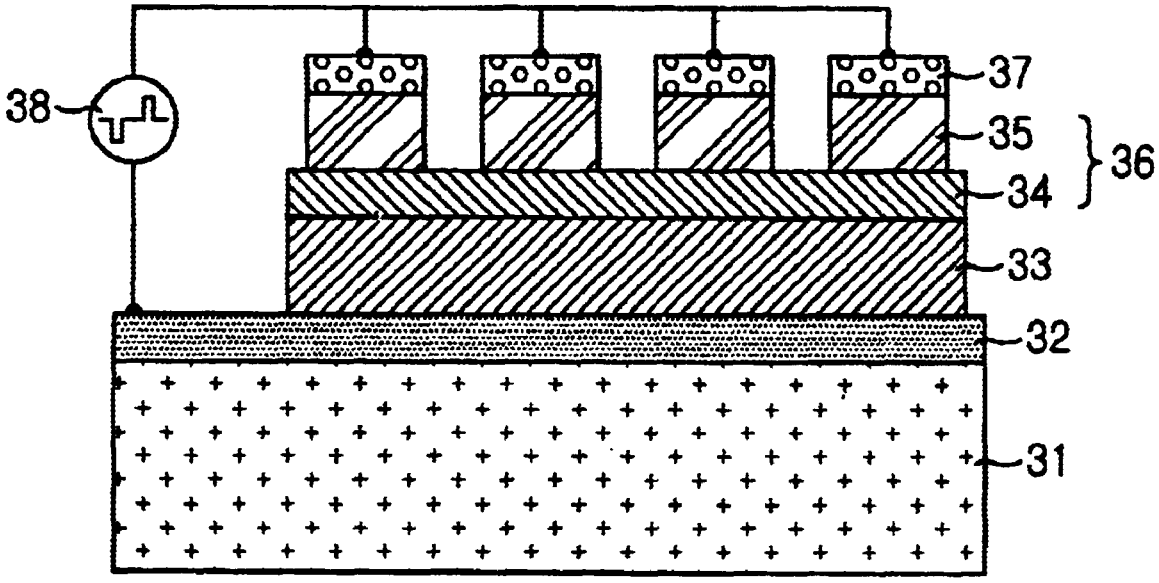
FIG. 4 illustrates a structural sectional view of a DC thin-film ELD in a second embodiment of the present invention.

FIG. 4 is a structural sectional view of a DC type thin-film ELD, having an energy barrier layer and a current-limiting layer separately, as a second embodiment of the present invention. In FIG. 4, it is provided a structure laminated in order by transparent electrodes 32, a thin-film phosphor layer 33, a thin-film energy barrier layer 34, a thin-film current-limiting layer 35 and metal electrodes 37 on a transparent substrate 31, and it is also constructed in such a way that a positive voltage pulse against the metal electrodes 37 is applied to the transparent electrodes 32 by using a pulse type DC power supplying equipment 38.

The materials for the second embodiment of the present invention are the same to the corresponding materials of the first embodiment in FIG. 2. The distinct difference between the first and the second embodiment is that the thin-film current control layer 36 is fabricated by sequential deposition of the thin-film energy barrier layer 34 and the thin-film current-limiting layer 35 on the thin-film phosphor layer 33 instead of one current control layer 26 in FIG. 2. In this second embodiment, the current control layer 36 separately formed by an energy barrier layer and current limiting layer is advantageous to control the electric field breakdown of the device from the excessive current flow through the device by limiting a maximum density of current and the energetic electron supply into the phosphor layer by a field-assistant injection of electron, effectively.

Figure 5:
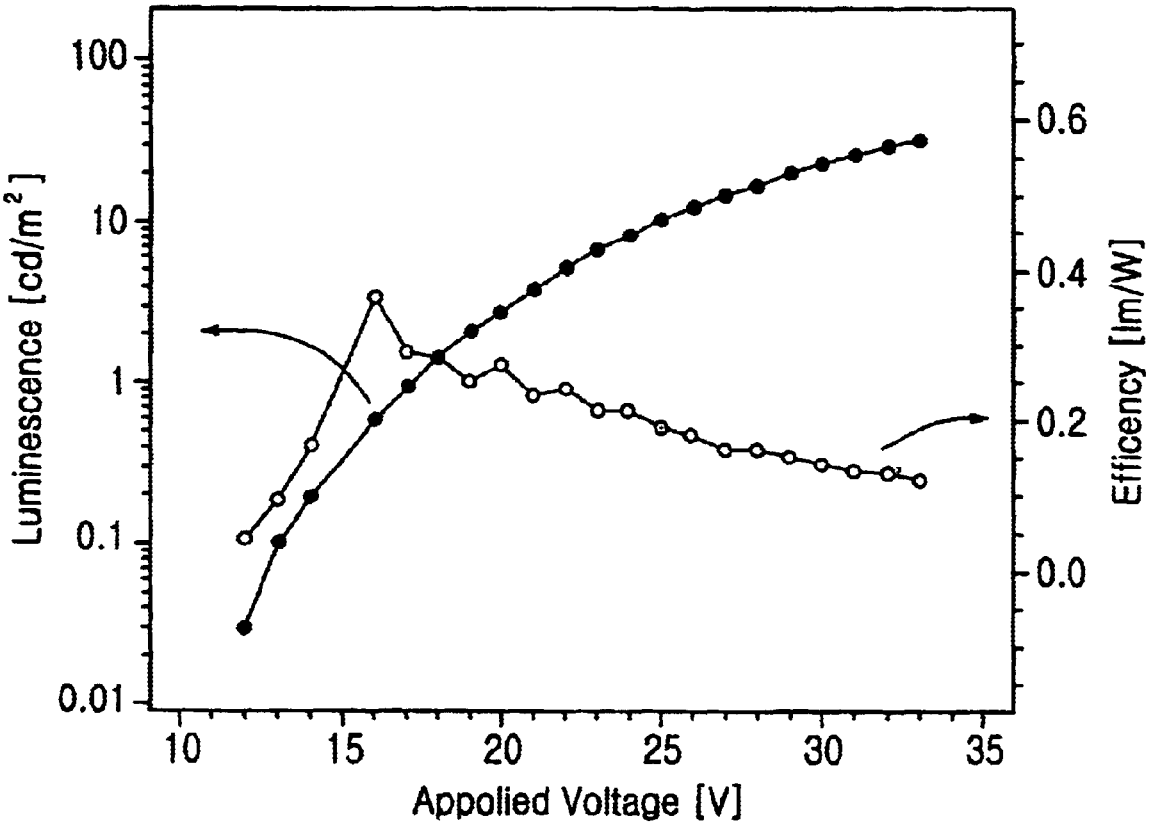
FIG. 5 illustrates a luminance and efficiency as a function of applied voltage when positively biased to ITO electrode of CaS:Pb electroluminescent device.

The FIG. 5 shows a luminance-voltage and an efficiency-voltage characteristics of a CaS:Pb electroluminescent device when a dc voltage pulse is applied to the device with a positive polarity to the ITO electrode with respect to the aluminum electrode. The CaS:Pb device consists of transparent ITO electrodes, a 250-nm CaS:Pb active layer, a 50-nm ZnS energy barrier layer, and Al metal electrodes on a glass substrate, sequentially. The CaS:Pb and ZnS thin-films, with the polycrystalline cubic structure confirmed by x-ray diffraction measurements, was deposited by the atomic layer deposition using the precursors of $Ca(thd)_2$, $Pb(C_2H_5)_4$, and $H_2S$ for CaS:Pb and diethyl zinc and $H_2S$ for ZnS, respectively. The applied pulse has a unipolar rectangular waveform with pulse width of 2.5 ms and frequency of 100 Hz. The threshold voltage for electroluminescent emission was 17 V. As the voltage is increased the luminance increases and reaches a value of about 85 cd/$m^2$ at 46 V. On the other hand, the efficiency shows the highest value about 0.36 lm/W at threshold voltage and then decreases to 0.12 lm/W with increasing the applied voltage. The equivalent field for light emission (~0.6 MV/cm) is much lower than that required for conventional ac TFEL devices. This fact indicates that hot electrons injected into the active layer in this device has an electron source different from that of the conventional device, tunneling from the interface states between the phosphor layer and the insulating layer.

As afore-mentioned, in accordance with the present invention, in an ELD, a DC type thin-film ELD having lower driving voltage can be embodied in comparison with an AC type thin-film ELD based on a dual dielectric structure. In addition, the DC type thin-film ELD having high resolution of 1000 dpi or more can be embodied by manufacturing a thin-film current control layer. Therefore, these inventions are applicable to a portable display device based on the high resolution and the lower driving voltage such as a head-mounted display.

It will be apparent to those skilled in the art that various modifications and variations can be made in the present invention without deviating from the spirit or scope of the invention. Thus, it is intended that the present invention cover the modifications and variations of this invention provided they come within the scope of the appended claims and their equivalents.

What is claimed is:

1. A thin-film electroluminescent device comprising:

a stacking of a transparent substrate, transparent electrodes, a thin-film phosphor layer, a thin-film current control layer and metal electrodes, wherein the thin-film current control layer acts as an energy barrier layer, which supplies energetic electrons into the phosphor layer by a field-assistant injection of electron, and a current-limiting layer which prevents an electric field breakdown of said electroluminescent device caused by an excess current flow wherein the thin-film current control layer is a multilayered thin film laminated by an alternate deposition of $SiON/TiO_2$, $SiO_2/TiO_2$ and $Ta_5/TiO_2$, with an overall thickness of 50–500 nm.

2. The electroluminescent device of claim 1, wherein the thin-film current control layer is a multilayered thin film laminated by an alternate deposition of $Al_2O_3$ and $TiO_2$ with an overall thickness of 50–500 nm and a relative thickness ratio of $TiO_2$ to the overall total thickness is 0.1–0.8.

3. The electroluminescent device of claim 1, wherein a very thin (<10 nm) layer of oxide or sulfide films is further inserted between said phosphor layer and the transparent electrodes.

4. The electroluminescent device of claim 1, wherein the current control layer is formed by atomic layer deposition.

5. A thin-film electroluminescent device, comprising:

a stacking of a transparent substrate, transparent electrodes, a thin-film phosphor layer, a thin-film energy barrier layer, a thin-film current-limiting layer and metal electrodes, wherein the thin-film energy barrier layer supplies energetic electrons into the phosphor layer by a field-assistant injection of electron, and the thin-film current-limiting layer prevents an electric field breakdown of the electroluminescent device caused by an excess current flow wherein the thin-film current-limiting layer is a multilayered thin film laminated by an alternate deposition of $Al_2O_3$ and $TiO_2$ with an overall thickness of 50–500 nm and a relative thickness ratio of $TiO_2$ to the overall total thickness is 0.1–0.8.

6. The electroluminescent device of claim 5, wherein the energy barrier layer is provided as any one among any one II–VI Group compound out of ZnS, ZnO, ZnSe, CaS, CaSe, CaTe, SrS, SrSe, SrTe, CdS, BaO, BaS, BaSe and BaTe.

7. The electroluminescent device of claim 5, wherein a very thin (<10 nm) layer of oxide or sulfide films is further inserted between said phosphor layer and the transparent electrodes.

8. The electroluminescent device of claim 5, wherein the thin-film energy barrier layer and the thin-film current-limiting layer are formed by atomic layer deposition.

* * * * *